US010132571B2

(12) United States Patent
Yu et al.

(10) Patent No.: US 10,132,571 B2
(45) Date of Patent: Nov. 20, 2018

(54) KNOCKDOWN HEAT DISSIPATION UNIT

(71) Applicant: ASIA VITAL COMPONENTS CO., LTD., New Taipei (TW)

(72) Inventors: Ming-Han Yu, New Taipei (TW); Chung-Hua Liao, New Taipei (TW); Wen-Jui Chuang, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 134 days.

(21) Appl. No.: 14/875,715

(22) Filed: Oct. 6, 2015

(65) Prior Publication Data

US 2017/0097195 A1 Apr. 6, 2017

(51) Int. Cl.
*F28D 15/02* (2006.01)
*F28D 15/04* (2006.01)

(52) U.S. Cl.
CPC ..... *F28D 15/0275* (2013.01); *F28D 15/0233* (2013.01); *F28D 15/04* (2013.01)

(58) Field of Classification Search
CPC ..... F28D 15/0275
See application file for complete search history.

(56) References Cited

U.S. PATENT DOCUMENTS 5,825,087 A * 10/1998 Iruvanti ..... H01L 21/4878 257/706
6,968,890 B1 * 11/2005 Ghantiwala ..... F28D 15/0275 165/104.21
2004/0208688 A1 * 10/2004 Barbett ..... F16B 37/048 403/234
2012/0205084 A1 * 8/2012 Huang ..... G06F 1/203 165/181
2012/0222839 A1 * 9/2012 Huang ..... F28D 15/0233 165/104.26
2013/0020055 A1 * 1/2013 Wu ..... B23P 15/26 165/104.26
2015/0207190 A1 * 7/2015 Takeshi ..... H01M 10/6552 429/120

FOREIGN PATENT DOCUMENTS

WO WO 2014142033 A1 * 9/2014 ..... H01M 10/6552

* cited by examiner

*Primary Examiner* — Hung Q Nguyen
*Assistant Examiner* — Mark L Greene
(74) *Attorney, Agent, or Firm* — Jackson IPG PLLC; Demian K. Jackson

(57) ABSTRACT

A knockdown heat dissipation unit includes at least one combination body and multiple heat pipes. The combination body has two opposite connection sections. The heat pipes are respectively connected with the connection sections of the combination body to form a large area of thermal contact face. According to the structural design of the knockdown heat dissipation unit, the number of the heat pipes can be increased or reduced according to the heat dissipation requirement of a user. Also, the number of the heat pipes can be flexibly adjusted according to the size of a heat source to enhance the heat dissipation effect.

4 Claims, 9 Drawing Sheets

KNOCKDOWN HEAT DISSIPATION UNIT

BACKGROUND OF THE INVENTION

1. Field of the Invention

The present invention relates generally to a knockdown heat dissipation unit, and more particularly to a knockdown heat dissipation unit, in which the number of the heat pipes can be adjusted according to the heat dissipation requirement of a user to enhance the heat dissipation effect.

2. Description of the Related Art

Along with the advance of technologies, the number of transistors per unit area of electronic component has become more and more. This leads to increase of heat generated by the electronic component in working. On the other hand, the working frequency of the electronic component has become higher and higher. In working, the heat generated by the transistors when switched on/off is the main cause of increase of the heat generated by the electronic component. In case the heat is not properly dissipated, the heat will lead to slowdown of the operation speed of the chip or even shorten the lifetime of the chip in some more serious cases. In order to enhance the heat dissipation effect of the electronic component, a passive heat dissipation unit such as a heat sink and/or heat pipe and/or vapor chamber is used to conductive heat. Under such circumstance, the heat generated by a heat source can be dissipated to the environment by the radiating fins of the heat sink by way of natural convection or forced convection.

The heat pipe can transfer a great amount of heat to a remote place to dissipate the heat by a very small cross-sectional area under very small temperature difference without any additional power supply. Therefore, in consideration of economical factors including power-freeness and space utility, various heat pipes have been widely applied to electronic products as one of the most often used heat transfer components.

The most often employed means for dissipating heat is to mount a heat dissipation unit (such as a heat sink) on the heat source, especially a heat sink equipped with heat pipe structures. The heat sink is made of a material with high heat conductivity. A working fluid and capillary textures are disposed in the heat pipe, whereby the heat sink has the property of high heat conduction. Moreover, the heat sink has the advantage of lightweight in structure. Therefore, the heat sink is free from the shortcoming of heavy weight of the conventional heat dissipation device. Also, the heat sink solves the problems of the conventional heat dissipation device that the cost is high and the system is complicated.

Conventionally, the heat sink equipped with the heat pipe structures and mounted on the heat source has a fixed configuration. That is, both the number and size of the heat pipes of the heat sink cannot be changed. Therefore, it is impossible for a user to flexibly adjust the number of the heat pipes according to the size of the heat source. In addition, the heat pipe cannot be solely used. It is necessary to connect the heat pipe with a heat sink or a base seat for practical use. Therefore, the heat generated by the heat source is first conducted to the base seat or the heat sink and then transferred to the heat pipe for remote-end heat dissipation. As a result, the heat pipe cannot directly contact the heat source to transfer the heat so as to enhance the heat transfer efficiency. Also, the assembly of the heat pipe and the heat sink cannot be adjusted according to the heat dissipation requirement so that the application of the assembly is limited.

In conclusion, the conventional heat dissipation unit has the following advantages:

1. The number of the heat pipes cannot be adjusted according to the heat dissipation requirement of a user.
2. The number of the heat pipes cannot be flexibly adjusted according to the size of the heat source.

SUMMARY OF THE INVENTION

It is therefore a primary object of the present invention to provide a knockdown heat dissipation unit, which can enhance the heat dissipation effect.

It is a further object of the present invention to provide the above knockdown heat dissipation unit, in which the number of the heat pipes can be flexibly adjusted according to the size of the heat source.

To achieve the above and other objects, the knockdown heat dissipation unit of the present invention includes at least one combination body and multiple heat pipes. The combination body has two opposite connection sections. The heat pipes are respectively connected with the connection sections of the combination body by means of press fit, welding or adhesion to form a large area of thermal contact face.

According to the structural design of the knockdown heat dissipation unit of the present invention, the number of the heat pipes can be adjusted according to the thermal wattage to be dissipated as required by a user. Also, the number of the heat pipes can be adjusted according to the size or number of the heat sources. In addition, the number of the heat pipes can be adjusted according to the distance between the arrangement positions of the heat sources. In the case that the heat source has a relatively large size or the distance between multiple heat sources is relatively long, multiple combination bodies and heat pipes can be alternately arranged and assembled to form the knockdown heat dissipation unit. In the case that the heat source has a relatively small size or the distance between multiple heat sources is relatively short, the numbers of the heat pipes and the combination bodies can be reduced. Therefore, thanks to the structure of the combination body, the size of the knockdown heat dissipation unit can be freely flexibly changed to enhance the heat dissipation effect.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
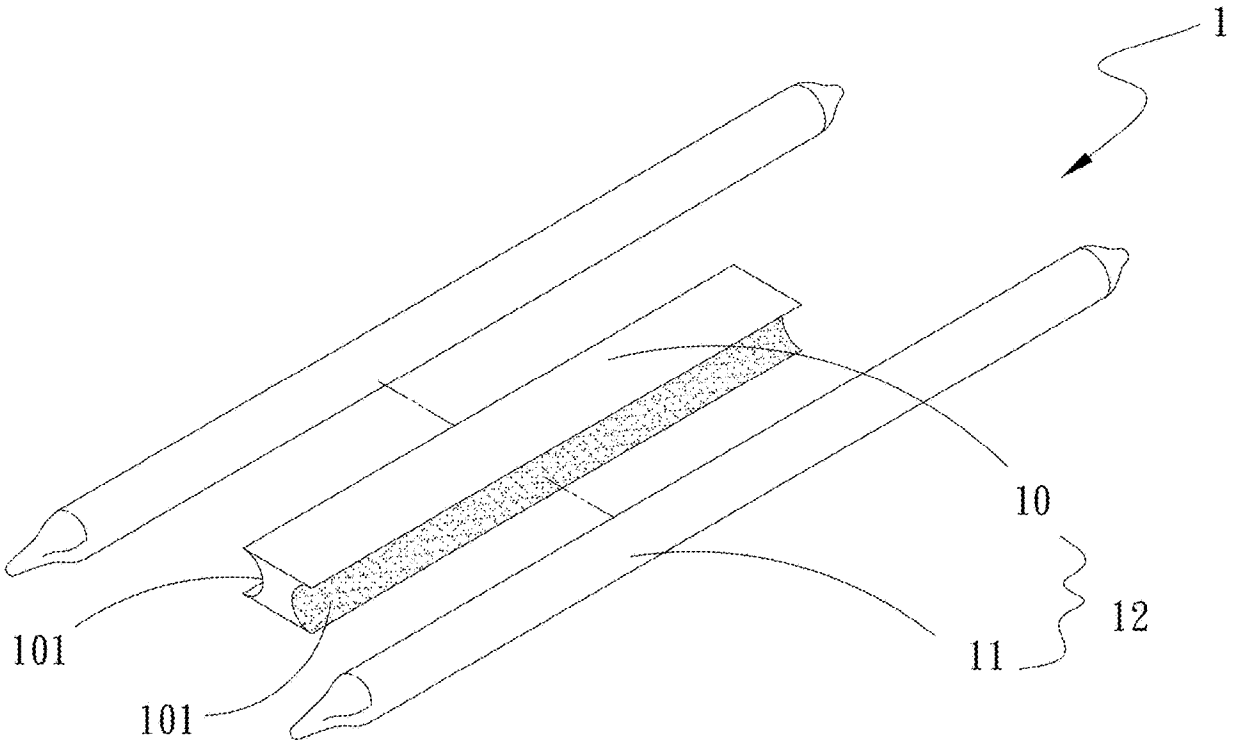
FIG. 1 is a perspective exploded view of a first embodiment of the knockdown heat dissipation unit of the present invention.
Figure 2:
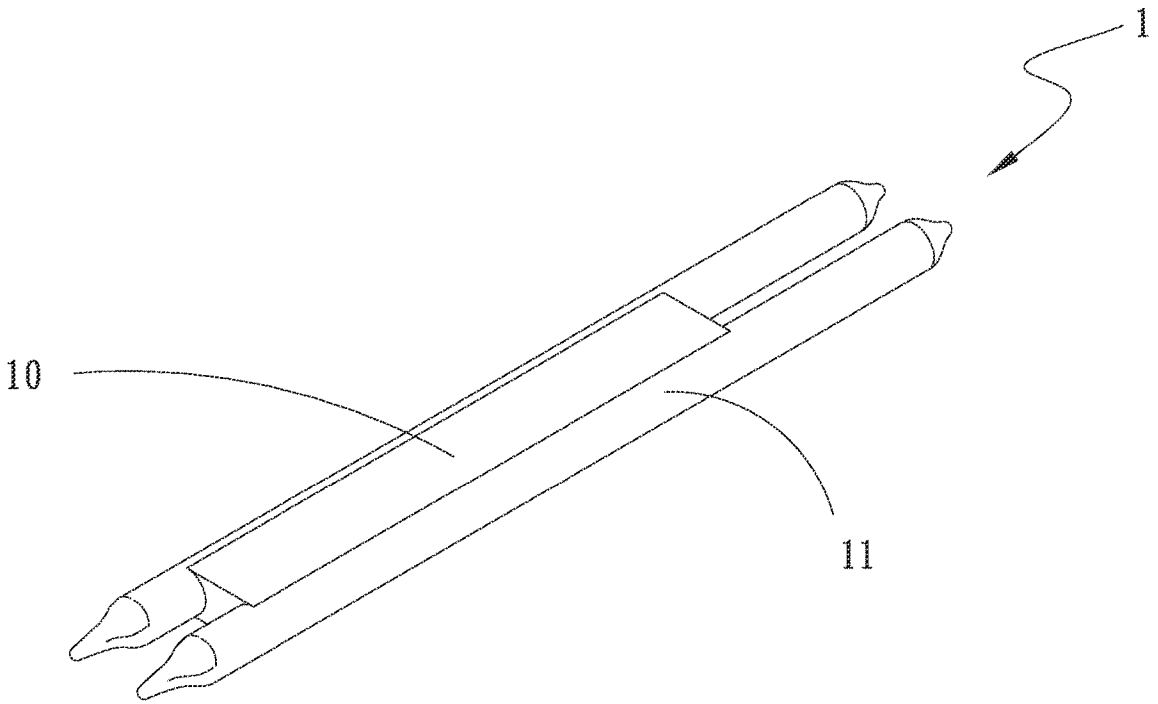
FIG. 2 is a perspective assembled view of the first embodiment of the knockdown heat dissipation unit of the present invention.

Please refer to FIGS. 1 and 2. FIG. 1 is a perspective exploded view of a first embodiment of the knockdown heat dissipation unit of the present invention. FIG. 2 is a perspective assembled view of the first embodiment of the knockdown heat dissipation unit of the present invention. According to the first embodiment, the knockdown heat dissipation unit 1 of the present invention includes at least one combination body 10 and multiple heat pipes 11. The combination body 10 has two opposite connection sections 101. The heat pipes 11 are respectively connected with the connection sections 101 of the combination body 10 by means of press fit, welding, or adhesion to form a large area of thermal contact face 12. After assembled, the heat pipes 11 and the combination body 10 together form a configuration similar to a vapor chamber with heat spreading and remote-end heat dissipation effects.

In addition, in this embodiment, the two heat pipes 11 can be assembled with the combination body 10 in such a form that the ends of the two heat pipes 11 are flush with each other or the two heat pipes 11 are respectively positioned in a front position and a rear position.

Figure 3:
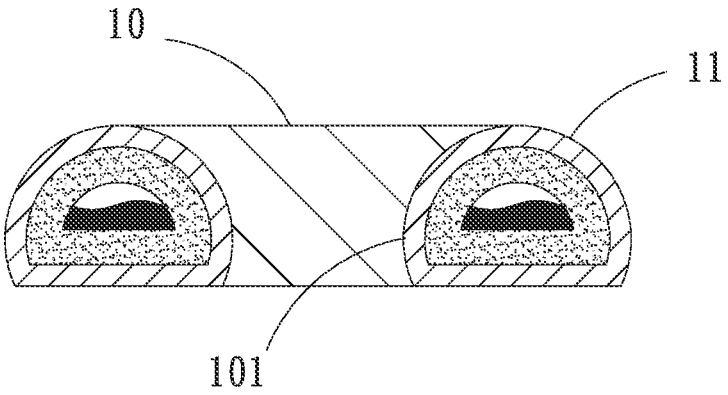
FIG. 3 is a sectional view of a second embodiment of the knockdown heat dissipation unit of the present invention.
Figure 4:
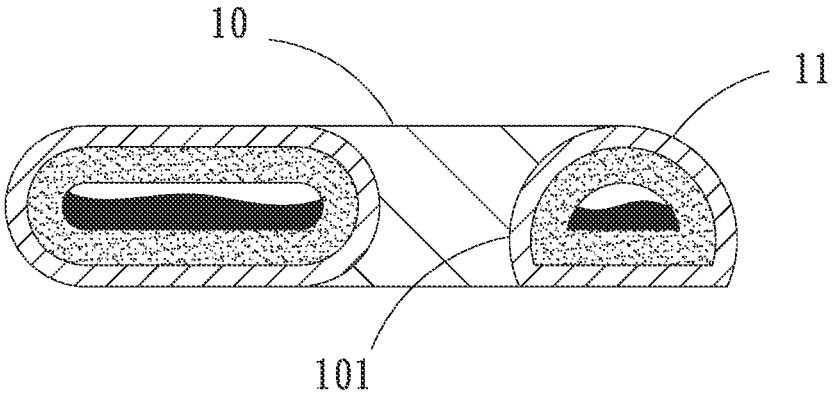
FIG. 4 is a sectional view of a third embodiment of the knockdown heat dissipation unit of the present invention.

Besides, in this embodiment, the cross section of the heat pipe 11 has, but not limited to, a circular shape. Alternatively, the cross section of the heat pipe 11 can have a semicircular shape (as shown in FIG. 3) or elliptical shape or flat-plate shape or any other shape. Alternatively, any two different shapes of heat pipes 11 can be assembled (as shown in FIG. 4). All these assemblies can achieve the same effect of the present invention.

Figure 5:
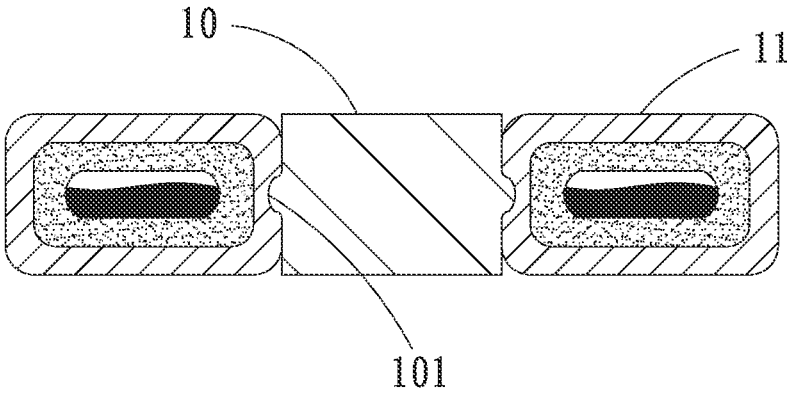
FIG. 5 is a sectional view of a fourth embodiment of the knockdown heat dissipation unit of the present invention.
Figure 6:
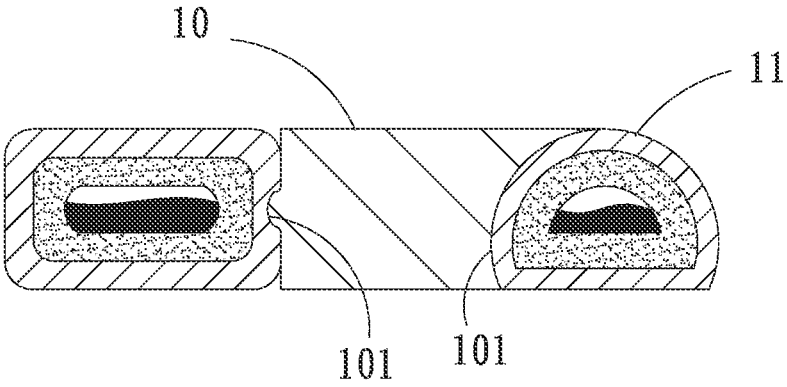
FIG. 6 is a sectional view of a fifth embodiment of the knockdown heat dissipation unit of the present invention.

Furthermore, in this embodiment, the configuration (volume and length) of the combination body 10 can be freely modified according to the requirement of a user. The combination body 10 can be made of a heat-conductive material or non-heat-conductive material. For example, the combination body 10 can be made of metal material or nonmetal material. The connection sections 101 can be designed with, but not limited to, the form of channels. Alternatively, the connection sections 101 can have the form of raised sections (as shown in FIG. 5, which is a sectional view of a fourth embodiment of the present invention). Alternatively, one of the connection sections 101 can have the form of a channel, while the other can have the form of a raised section (as shown in FIG. 6, which is a sectional view of a fifth embodiment of the present invention). All these forms can achieve the same effect of the present invention.

Figure 7:
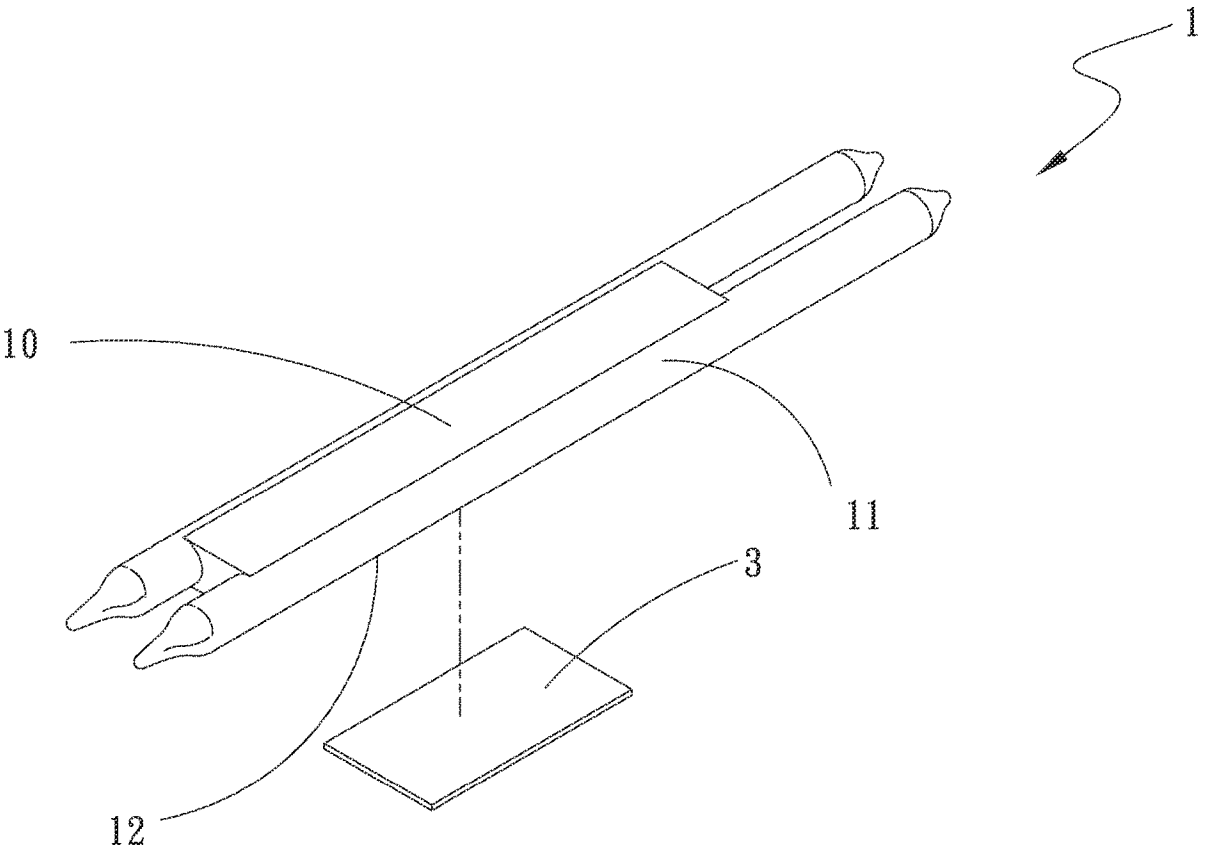
FIG. 7 is a perspective view of the first embodiment of the knockdown heat dissipation unit of the present invention, showing the application thereof.

Please now refer to FIG. 7, which is a perspective view of the first embodiment of the knockdown heat dissipation unit of the present invention, showing the application thereof. According to the structural design of the present invention, the thermal contact face 12 of the knockdown heat dissipation unit 1 is attached to a heat source 3. The number of the heat pipes 11 can be adjusted according to the thermal wattage to be dissipated as required by a user. Alternatively, the number of the heat pipes 11 can be adjusted according to the size or number of the heat source 3. In the case that the heat source 3 has a relatively large size, multiple combination bodies 10 and heat pipes 11 can be alternately arranged and assembled to form the knockdown heat dissipation unit 1. In the case that the heat source 3 has a relatively small size, the numbers of the heat pipes 11 and the combination bodies 10 can be reduced. Therefore, thanks to the structure of the combination body 10, the size of the knockdown heat dissipation unit 1 can be freely flexibly changed to enhance the heat dissipation effect.

Figure 8:
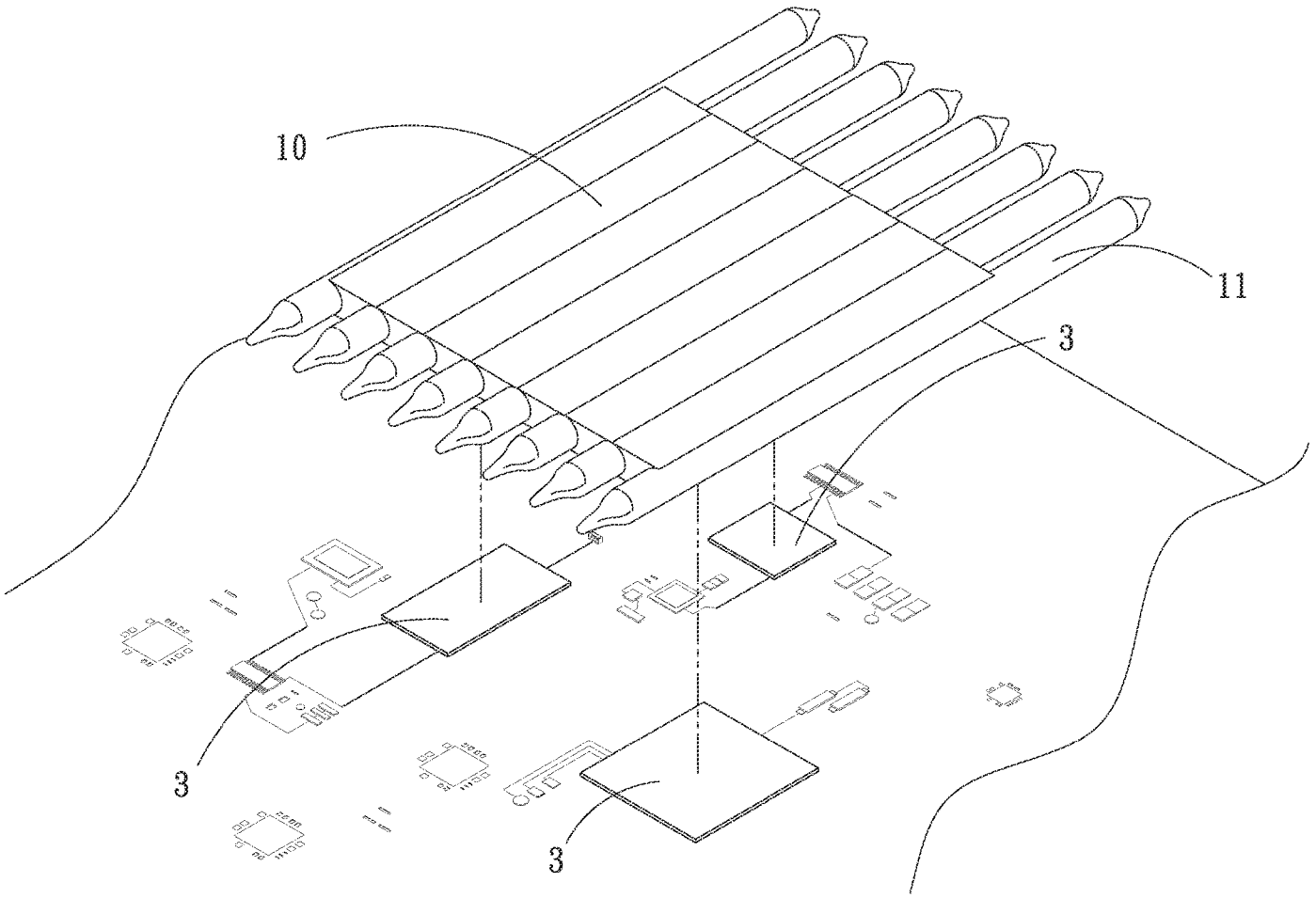
FIG. 8 is a perspective view of a sixth embodiment of the knockdown heat dissipation unit of the present invention, showing the application thereof.

In addition, referring to FIG. 8, in another embodiment, in the case that an electronic apparatus has multiple heat sources 3 inside and the heat sources 3 are spaced from each other by considerably long distances, the numbers of the combination bodies 10 and the heat pipes 11 can be increased to form the knockdown heat dissipation unit 1 with a larger area of thermal contact face 12. Under such circumstance, the knockdown heat dissipation unit 1 can fully cover the heat sources 3. Reversely, in the case that the heat sources 3 are spaced from each other by a relatively short distance, the numbers of the combination bodies 10 and the heat pipes 11 can be reduced. Accordingly, the number of heat pipes 11 can be freely flexibly adjusted to enhance the heat dissipation effect.

Figure 9:
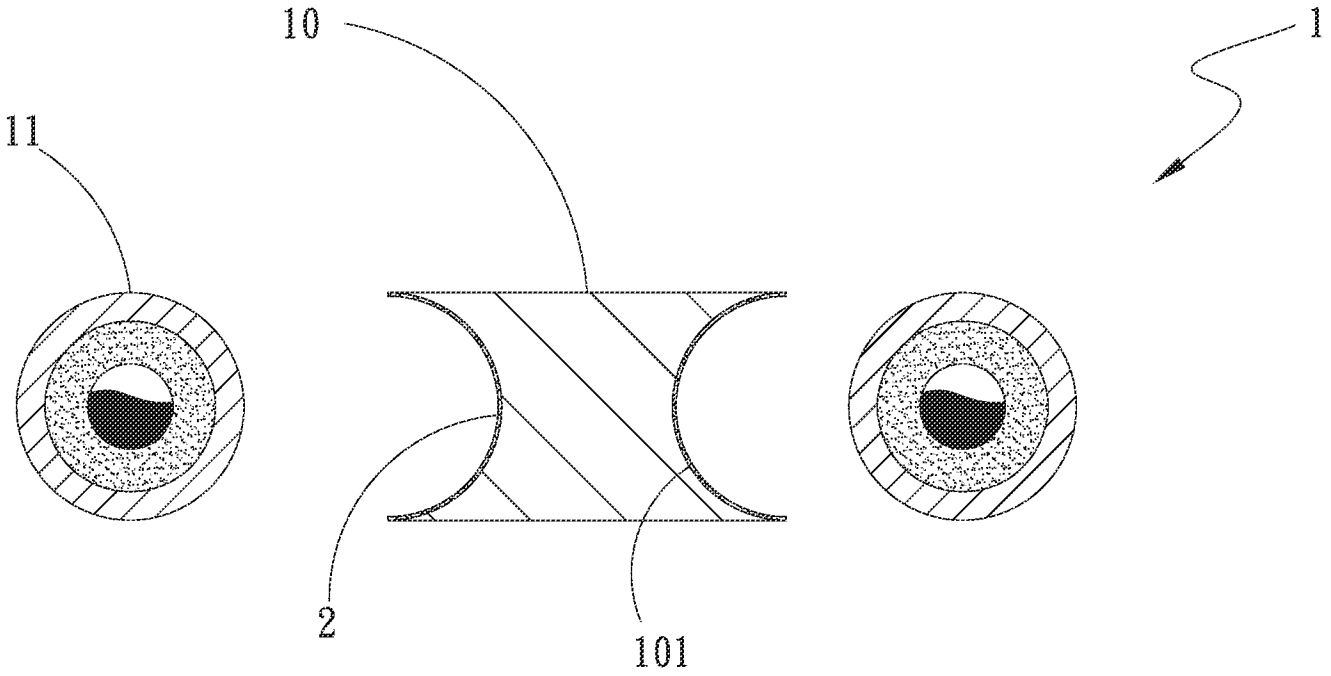
FIG. 9 is a sectional view of a seventh embodiment of the knockdown heat dissipation unit of the present invention.

Please now refer to FIG. 9, which is a sectional view of a seventh embodiment of the knockdown heat dissipation unit of the present invention. The seventh embodiment is partially identical to the first embodiment in component and relationship between the components and thus will not be repeatedly described. The seventh embodiment is mainly different from the first embodiment in that a heat-conductive medium 2 is further disposed between the combination body 10 and the heat pipes 11. The heat-conductive medium 2 is distributed and disposed in the connection sections 101. The heat-conductive medium 2 can be tin paste or bonding agent. By means of the heat-conductive medium 2, the heat pipes 11 can be tightly connected with the combination body 10.

Figure 10:
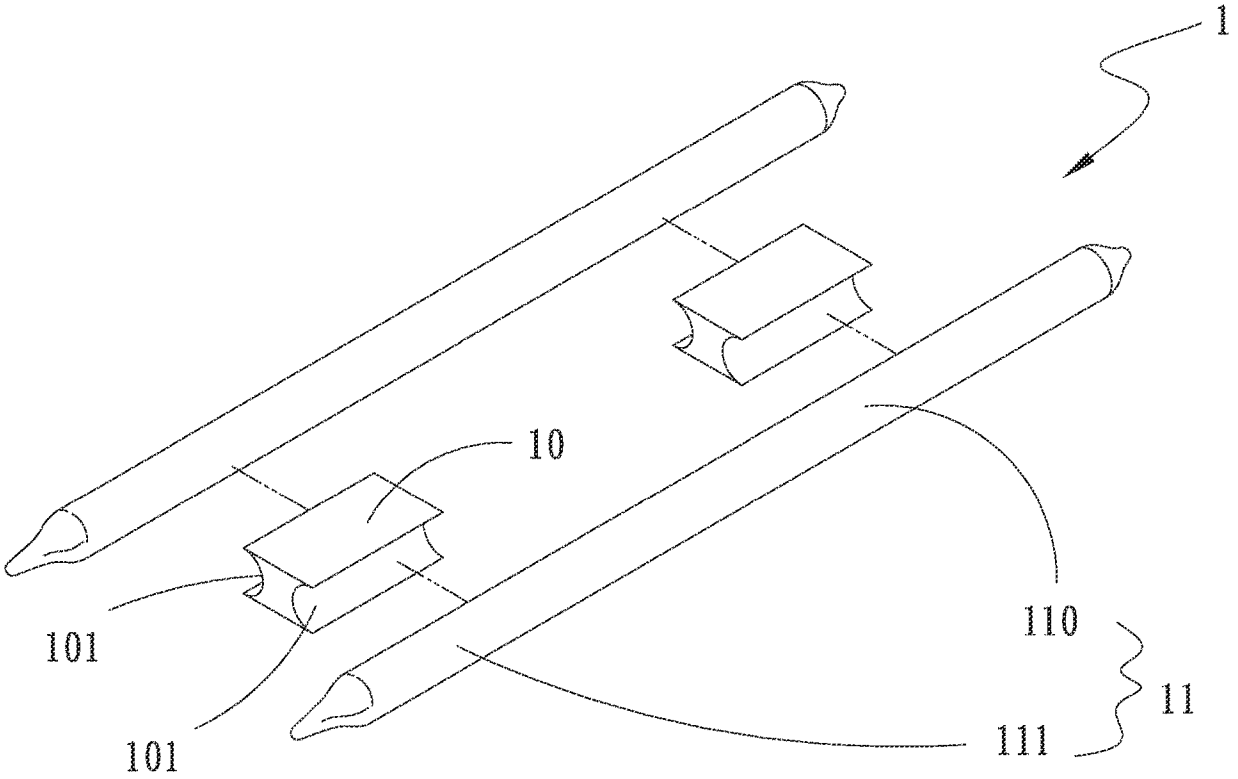
FIG. 10 is a perspective exploded view of an eighth embodiment of the knockdown heat dissipation unit of the present invention.

Please now refer to FIG. 10, which is a perspective exploded view of an eighth embodiment of the knockdown heat dissipation unit of the present invention. The eighth embodiment is partially identical to the first embodiment in component and relationship between the components and thus will not be repeatedly described. The eighth embodiment is mainly different from the first embodiment in that each heat pipe 11 has a first end 110 and a second end 111. The combination bodies 10 are respectively disposed at the first and second ends 110, 111 of the heat pipes 11. The connection sections 101 of the combination bodies 10 are respectively connected with the first and second ends 110, 111 of the heat pipes 11.

Figure 11:
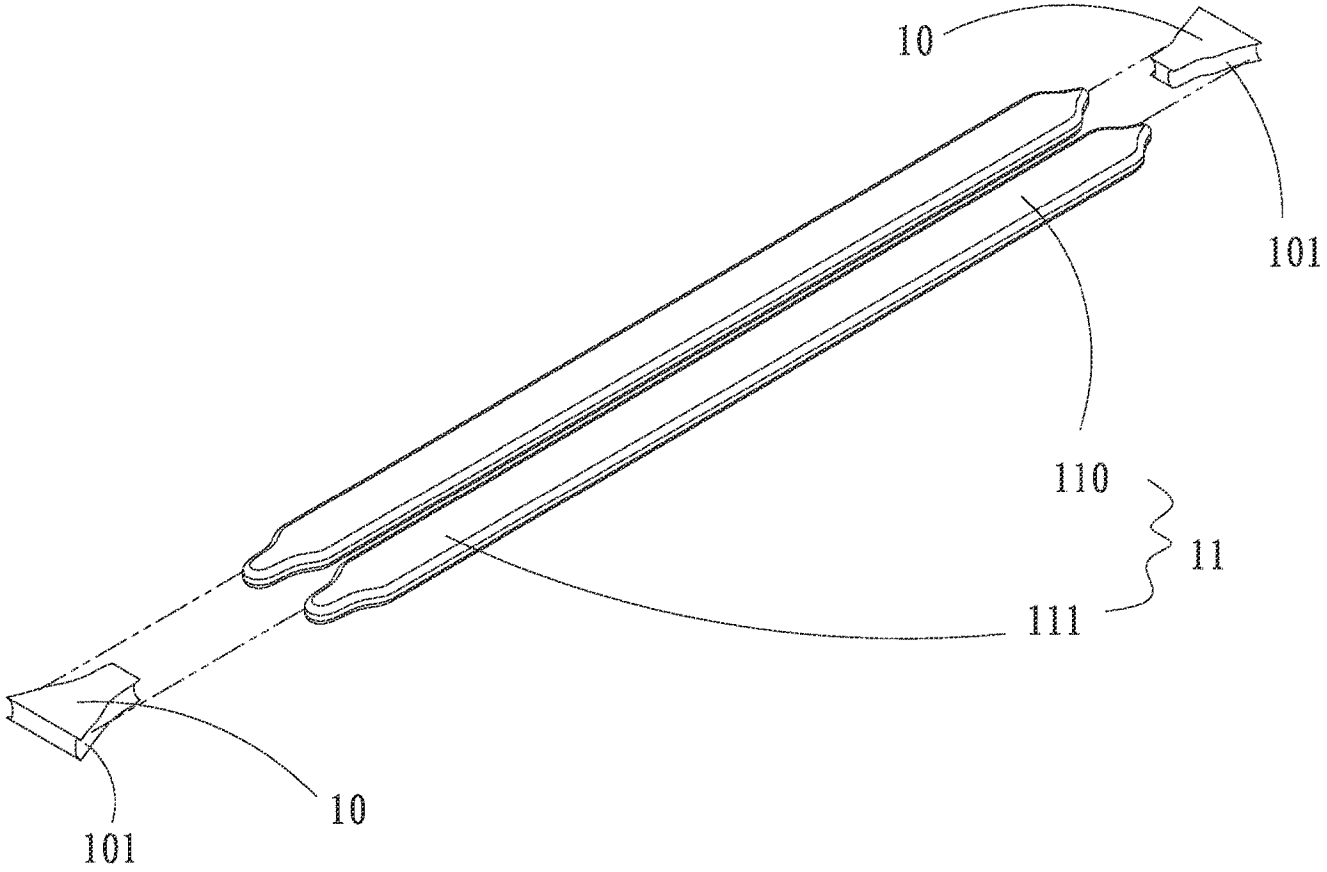
FIG. 11 is a perspective exploded view of a ninth embodiment of the knockdown heat dissipation unit of the present invention.

Please now refer to FIG. 11, which is a perspective exploded view of a ninth embodiment of the knockdown heat dissipation unit of the present invention. The ninth embodiment is partially identical to the eighth embodiment in component and relationship between the components and thus will not be repeatedly described. The ninth embodiment is mainly different from the eighth embodiment in that the combination bodies 10 are respectively disposed at the free ends of the first and second ends 110, 111 of the heat pipes 11. The connection sections 101 of the combination bodies

10 are respectively connected with the free ends of the first and second ends 110, 111. This can also achieve the above effect.

In addition, the connection sections 101 of the combination bodies 10 can be formed with rough surfaces or recessed/raised sections for more tightly connecting with the heat pipes 11.

In conclusion, in comparison with the conventional heat dissipation unit, the present invention has the following advantages:

1. The number of the heat pipes can be adjusted according to the heat dissipation requirement of a user.
2. The number of the heat pipes can be flexibly adjusted according to the size of the heat source.
3. The heat dissipation effect is enhanced.

The present invention has been described with the above embodiments thereof and it is understood that many changes and modifications in the above embodiments can be carried out without departing from the scope and the spirit of the invention that is intended to be limited only by the appended claims.

What is claimed is:

1. A knockdown heat dissipation unit comprising:

a plurality of combination bodies each having a top side, a bottom side, and a concave connection section on each of two opposite lateral sides, the concave connection sections formed with rough surfaces; and a plurality of heat pipes each having a top side, a bottom side, and a convex connection section on each of two opposite lateral sides;

wherein each of the plurality of combination bodies and each of the plurality of heat pipes are alternately arranged along a horizontal direction such that the convex connection sections adjacent to the concave connection sections are engaged by the rough surfaces for more tightly connecting the plurality of combination bodies with the plurality of heat pipes;

wherein the top sides of the plurality of combination bodies and the top sides of the plurality of heat pipes are coplanar and jointly form a composite top surface that extends in the horizontal direction; and wherein the bottom sides of the plurality of combination bodies and the bottom sides of the plurality of heat pipes are coplanar and jointly form a composite thermal contact surface that extends in the horizontal direction.

2. The knockdown heat dissipation unit of claim 1, wherein each of the plurality of combination bodies is made of heat-conductive material or non-heat-conductive material.

3. The knockdown heat dissipation unit of claim 1, wherein a cross-sectional shape of each of the plurality of heat pipes is a circular shape, an elliptical shape, a semi-circular shape, or a flat-plate shape.

4. The knockdown heat dissipation unit of claim 1, wherein each of the plurality combination bodies is connected to at least one of the plurality of heat pipes by means of welding or adhesion.

* * * * *